United States Patent [19]

Wochele

[11] 4,298,058

[45] Nov. 3, 1981

[54] TUBE BUNDLE HEAT EXCHANGER

[75] Inventor: Jörg Wochele, Zofingen, Switzerland

[73] Assignee: BBC, Brown, Boveri & Company Limited, Baden, Switzerland

[21] Appl. No.: 33,421

[22] Filed: Apr. 26, 1979

[30] Foreign Application Priority Data

Apr. 28, 1978 [CH] Switzerland ..... 4629/78

[51] Int. Cl.[3] ..... F28F 9/22; F28D 7/10

[52] U.S. Cl. ..... 165/161

[58] Field of Search ..... 165/159–161; 122/34, 32

[56] References Cited

U.S. PATENT DOCUMENTS 3,731,733 5/1973 Trebaud ..... 165/161

4,029,145 6/1977 Pfouts ..... 165/161

FOREIGN PATENT DOCUMENTS 1239498 7/1960 France ..... 165/160

*Primary Examiner*—Samuel Scott

*Assistant Examiner*—Theophil W. Streule, Jr.

*Attorney, Agent, or Firm*—Burns, Doane, Swecker & Mathis

[57] ABSTRACT

A tube bundle heat exchanger with baffles is disclosed wherein a tube bundle is housed within an inner casing which is acted upon from both the inside and the outside by a heating medium. The inner casing is not stressed by pressure caused by the heating medium since the medium flows both within and without the casing. The part of the circumference of each baffle which is in contact with the inner casing is tightly connected to the inner casing in order to prevent leak flows. Adjacent heat exchanger tubes of the tube bundle are separated from one another by a zigzag-shaped dividing wall. The dividing wall forms space-economical rerouting channels with the baffles. The tubes of the tube bundle are located parallel to the longitudinal axis of the heat exchanger, and therefore longitudinal in the longitudinal rerouting channels. The heating medium which flows through the rerouting channels flows across the tubes producing favorable heat transfer conditions.

4 Claims, 3 Drawing Figures

TUBE BUNDLE HEAT EXCHANGER

BACKGROUND OF THE INVENTION

This invention relates generally to heat exchangers, and more particularly to a tube bundle heat exchanger with baffles.

In conventional tube bundle heat exchangers, baffles are used to cause the heating medium to flow both crossways and parallel to the tube bundle in order to utilize the heat exchanger surface as completely as possible. The heat transfer takes place by convection. The baffles generally slide over the tubes and are fastened at prescribed points to a casing in which the tubes are housed. Between adjacent prescribed fastening points exists a slot between the baffle and the casing. The slots constitute leaks which reduce the efficiency of the heat exchanger. The severity of the leaks vary with baffle design and with different methods of attaching the baffles to the casing.

In heat exchanges in which fluids flow at high velocities, the velocity of the fluid flowing through the slots can become so high that corrosion and erosion occur primarily due to cavitation at the baffle and at the adjacent tube and casing.

It is therefore an object of this invention to provide a heat exchanger of high efficiency and without leak flows.

According to a preferred embodiment of the present invention, the tube bundles of the heat exchanger are housed in an inner casing. The heating medium flows both inside and outside of the inner casing so that the inner casing is not subject to stresses caused by pressure. Baffles included in the heat exchanger are connected to the inner casing in such a way as to prevent leak flows. Adjacent tubes of the tube bundle are separated by a zigzag-dividing wall. The dividing wall and the baffles form rerouting channels for the heating medium. Efficient heat transfer is obtained by locating the tubes of the tube bundle longitudinally in essentially longitudinal rerouting channels.

BRIEF DESCRIPTION OF THE DRAWINGS

The preferred embodiment of the invention is described with reference to the accompanying drawings wherein like members bear like reference numerals and wherein.

DETAILED DESCRIPTION OF THE PREFERRED EMBODIMENT

Figure 1:
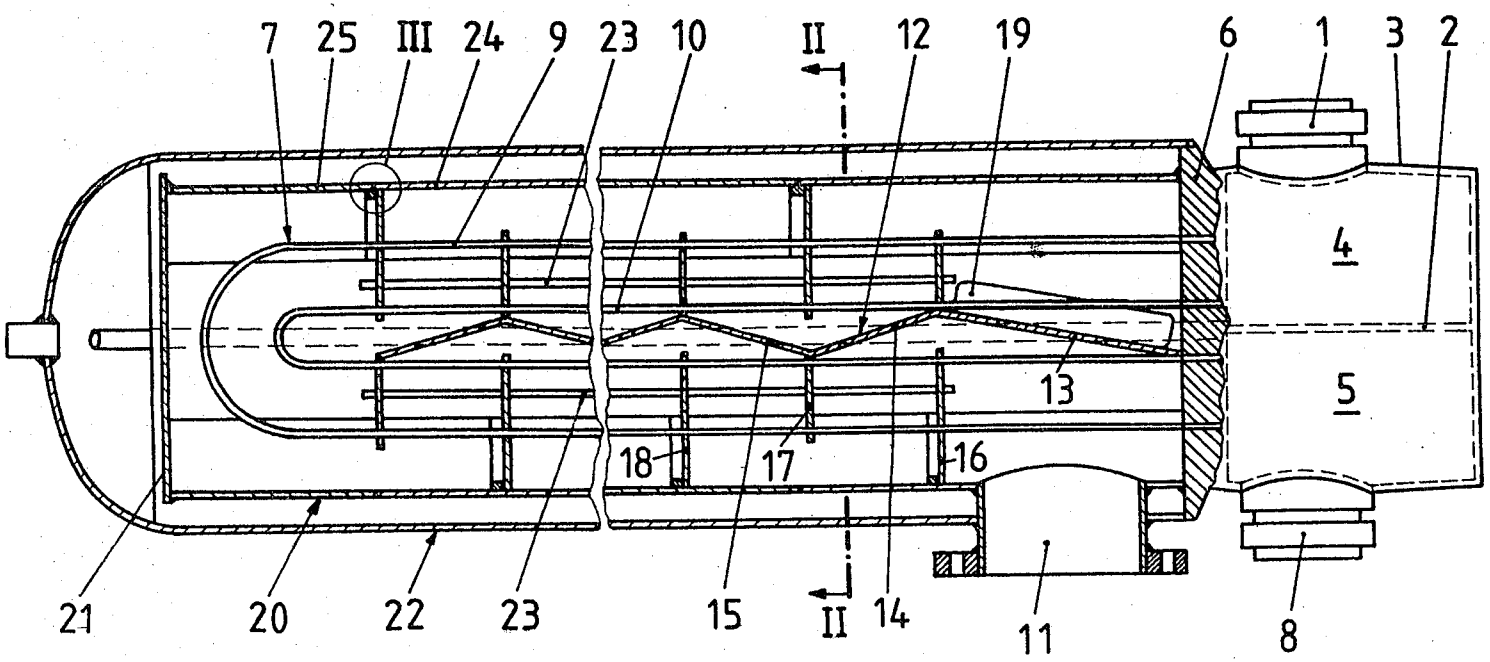
FIG. 1 is a cross-sectional view of a tube bundle heat exchanger according to the present invention.

With reference to FIG. 1, a tube bundle heat exchanger according to the present invention includes a tube bundle 7 which consists of a plurality of U-shaped bent tubes. For the sake of clarity, only an outermost tube layer 9 and an innermost tube layer 10 are illustrated. Each tube has a first tube end in communication with an upper water chamber 4 of a collector 3, and a second tube end in communication with a lower water chamber 5 of the collector 3. The chambers 4 and 5 are separated in the collector by a horizontal partition 2. Both the first and second tube ends of each tube are expanded in a tube sheet 6.

Water which is to be heated in the heat exchanger flows through an inlet pipe connection 1 into the upper water chamber 4 and then into the first tube ends of the tube bundle 7. The water then flows through the tube bundle and is heated. The heated water is then discharged from the second tube ends of the tube bundle into the lower water chamber 5. The water then flows out of the heat exchanger through an outlet pipe connection 8.

The heating medium, such as flue gas or exhaust steam, enters the heat exchanger through an inlet pipe connection 11. The heating medium then flows through a zigzag-shaped rerouting channel formed by a horizontally arranged dividing wall 12 and a plurality of vertical baffles, of which only some, 16, 17 and 18, are illustrated. The heating medium is then diverted upward in the conventional manner at the left hand end of the heat exchanger in the region of the curved portion of the U-shaped tubes of the tube bundle. The heating medium then flows through a zigzag-shaped channel located above the dividing wall 12 and leaves the heat exchanger through an outlet pipe connection 19 in the horizontal center plane of the heat exchanger.

The dividing wall 12 includes a plurality of oblique wall sections, of which only some, 13, 14 and 15, are illustrated.

The tube bundle 7, the dividing wall 12 and the vertical baffles form a single unit which is enclosed by an inner casing 20 and an end member 21. A pressure-tight outer casing 22, which includes a curved boiler bottom, encloses the inner casing and the end member. The open end of the outer casing is welded pressure-tight to the circumference of the tube sheet 6.

Figure 3:
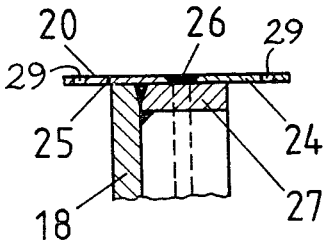
FIG. 3 is an enlarged cross-sectional view of the detail III of FIG. 1.

The inner casing 20 is arranged freely movable in its axial direction within the outer casing 22 in order that the inner casing may absorb the hydrostatic compressive forces which may act upon it. The region between the inner casing and the outer casing is connected for example, by apertures 29, as shown in FIG. 3, to the region inside the inner casing so that both regions are at approximately the same pressure thereby insuring that the inner casing is not loaded by the pressure of the heating medium. A plurality of carrier supports 23 reinforce and axially connect the baffles.

Figure 2:
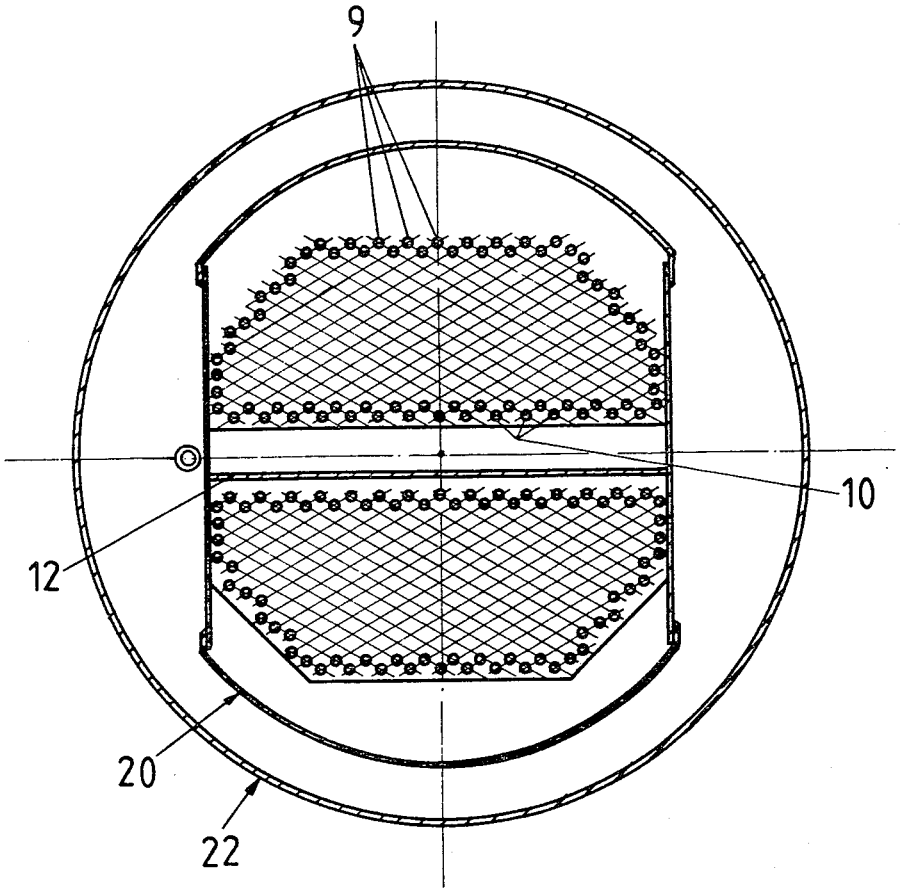
FIG. 2 is a view through the line II—II of FIG. 1.

With reference to FIG. 2, the plurality of tubes included in the outermost tube layer 9 are illustrated. The plurality of tubes included in the innermost tube layer 10 are also illustrated. The inner casing 20 is concentric with the outer casing 22. And, the dividing wall 12 extends across the region enclosed by the inner casing.

The inner casing 20 includes a plurality of individual boiler shell-rings situated such that one shell-ring abuts another. With reference to FIG. 3, abutting shell-rings 24 and 25 are illustrated. The vertical baffle 18 is located in the region of abutment of the shell-rings. And, a welding seam 26 forms a joint between the abutting shell-rings.

A welding ring 27, which is welded onto the baffle 18, is used to center the joint and stiffen the interface between the abutting boiler shell-rings. During assembly the boiler shell-rings 24 and 25 are pushed onto the ring 27 before the seam 26 is welded. Thus the boiler shell-rings 24 and 25 are not only welded to one another but are also welded to the ring 27. Consequently, the baffle is tightly connected both to the welding ring and to the inner casing over the entire circumference of the baffle in contact with the inner casing, and therefore, virtually no leak flow can occur. By eliminating the leak flow, the tubes are essentially only streamed diagonal to their axis, and thus the optimum heat transfer occurs. Since no tubes in the rerouting channels are streamed longitudinally, the poor heat transfer loses resulting from such heating medium flow are greatly reduced or eliminated.

The rerouting spaces in the vicinity of the dividing wall 12 are quite small due to the zigzagged-shape of the dividing wall. Therefore it is possible to keep the casing diameter relatively small with respect to conventional heat exchanges of equal performance. By avoiding leak flows, corrosion and erosion primarily caused by cavitation are eliminated.

The present heat exchanger achieves a uniformly good thermodynamic utilization over the entire heat exchanger surface as a result of the heating medium flowing vertical to the tube bundle. Consequently, the apparatus according to the present invention utilizes a smaller heat exchanger surface than that required by conventional heat exchangers of equal performance. As a result of the more accurately defined flow channels in the heat exchanger according to the present invention, flow and heat transfer can be more accurately computed before hand, and therefore, a more reliable heat exchanger can readily be had.

The principles, preferred embodiments and modes of operation of the present invention have been described in the foregong specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. A tube bundle heat exchanger for exchanging heat between a first fluid and a second fluid, comprising:

a first casing;

a second pressure-tight casing mounted about said first casing such that said first casing is freely movable in its longitudinal direction within the second casing;

pressure equalizing means included on said first casing for approximately equalizing the pressure in the region enclosed by said first casing to the pressure in the region between said first casing and said second casing;

a plurality of heat exchanger tubes contained in said first casing, each tube having an inner surface and an outer surface, one of said surfaces being in communication with said first fluid, and the other of said surfaces being in communication with said second fluid;

zigzag-shaped dividing wall means, defining oblique wall sections, and baffle means for forming a conduit for directing the flow of said second fluid such that the flow is substantially only diagonal to said heat exchanger tubes; said dividing wall means extending longitudinally with respect thereto being fixedly connected between adjacent heat exchanger tubes and said baffle means including baffles which are tightly connected to said first casing and which extend normal to said heat exchange tubes.

2. A heat exchanger according to claim 1 wherein said first casing comprises:

a plurality of abutting boiler shell-rings, wherein each abutting shell-ring is pressure-sealed one to the other.

3. A heat exchanger according to claim 2 wherein said abutting shell-rings are welded one to the other, said baffles are pressure-sealed to said first casing in the region of abutment of abutting boiler shell-rings; and a welding ring is welded to said baffles and to said first casing in the region of abutment between abutting boiler shell-rings.

4. A tube bundle heat exchanger according to claim 1 wherein said dividing wall means is centrally disposed with respect to said heat exchanger tubes, and said baffle means comprises further baffles extending from said dividing wall means, said further baffles being disposed so as to extend normal to said heat exchanger tubes and such that said baffles alternate with said further baffles.

* * * * *